US008496450B2

(12) United States Patent
Mellar et al.

(10) Patent No.: US 8,496,450 B2
(45) Date of Patent: Jul. 30, 2013

(54) COMPRESSOR SYSTEM FOR SUPPLYING COMPRESSED AIR TO A COMMERCIAL VEHICLE, AND METHOD FOR OPERATING THE COMPRESSOR SYSTEM

(75) Inventors: Joerg Mellar, Pliening (DE); Gilles Hebrard, Caen (FR)

(73) Assignee: KNORR-BREMSE Systeme fuer Nutzfahrzeuge GmbH, Munich (DE)

( * ) Notice: Subject to any disclaimer, the term of this patent is extended or adjusted under 35 U.S.C. 154(b) by 142 days.

(21) Appl. No.: 12/959,444

(22) Filed: Dec. 3, 2010

(65) Prior Publication Data

US 2011/0135510 A1 Jun. 9, 2011

Related U.S. Application Data

(63) Continuation of application No. PCT/EP2009/003995, filed on Jun. 4, 2009.

(30) Foreign Application Priority Data

Jun. 4, 2008 (DE) ..... 10 2008 026 684

(51) Int. Cl.
*F04B 47/08* (2006.01)

(52) U.S. Cl.
USPC ..... 417/379; 417/319; 417/375

(58) Field of Classification Search
USPC ..... 417/319, 375, 379
See application file for complete search history.

(56) References Cited

U.S. PATENT DOCUMENTS

| | | | | |
|---|---|---|---|---|
| 4,129,404 | A | 12/1978 | Koerner et al. | |
| 5,497,742 | A * | 3/1996 | Plantan | 123/197.5 |
| 6,668,953 | B1 | 12/2003 | Reik et al. | |
| 7,416,070 | B2 | 8/2008 | Winkelmann et al. | |
| 7,428,944 | B2 | 9/2008 | Gerum | |
| 2009/0120405 | A1 | 5/2009 | Gerum | |

FOREIGN PATENT DOCUMENTS

| | | | |
|---|---|---|---|
| DE | 10 2004 062 586 | A1 | 6/2006 |
| DE | 10 2005 013 027 | A1 | 10/2006 |
| DE | 10 2006 033 428 | A1 | 1/2008 |
| DE | 11 2007 000 153 | T5 | 8/2009 |
| EP | 1 830 094 | B1 | 4/2008 |
| FR | 2 797 230 | A1 | 2/2001 |
| GB | 2 073 827 | A | 10/1981 |
| WO | WO 96/09464 | A1 | 3/1996 |
| WO | WO 2007/136168 | A | 11/2007 |
| WO | WO 2007/136168 | A2 | 11/2007 |

OTHER PUBLICATIONS

International Search Report dated Sep. 17, 2009 with English translation (four pages).

German Office Action dated Feb. 17, 2009 with English translation (ten (10) pages).

German Examination Report dated Feb. 27, 2012 including English-language translation (Twelve (12) pages).

* cited by examiner

*Primary Examiner* — Charles Freay
*Assistant Examiner* — Patrick Hamo
(74) *Attorney, Agent, or Firm* — Crowell & Moring LLP

(57) ABSTRACT

A compressor system supplies compressed air to a commercial vehicle. The compressor system includes a compressor, a clutch, and a hydraulic pump and can be driven by way of a drivetrain. The compressor can be completely disconnected from a driving engine by way of the clutch. The drivetrain encompasses a geared drive mechanism which allows the hydraulic pump to be driven, and the clutch is arranged between the geared drive mechanism and the compressor. A method for operating the compressor system is provided.

10 Claims, 13 Drawing Sheets

COMPRESSOR SYSTEM FOR SUPPLYING COMPRESSED AIR TO A COMMERCIAL VEHICLE, AND METHOD FOR OPERATING THE COMPRESSOR SYSTEM

CROSS-REFERENCE TO RELATED APPLICATIONS

This application is a continuation of PCT International Application No. PCT/EP2009/003995, filed Jun. 4, 2009, which claims priority under 35 U.S.C. §119 from German Patent Application No. DE 10 2008 026 684.1, filed Jun. 4, 2008, the entire disclosures of which are herein expressly incorporated by reference.

BACKGROUND AND SUMMARY OF THE INVENTION

The invention relates to a compressor system for supplying compressed air in a commercial vehicle, having a compressor, a clutch and a hydraulic pump, with it being possible for the compressor system to be driven via a drivetrain and for the compressor to be completely decoupled from a drive engine by use of the clutch.

The invention also relates to a method for operating a compressor system for supplying compressed air in a commercial vehicle, having a compressor, a clutch and a hydraulic pump, with the compressor system being driven via a drivetrain and with the compressor being completely decoupled from the drive engine by use of the clutch.

Modern commercial vehicles have numerous subsystems which are operated with compressed air. These include, for example, a compressed-air-operated service brake or an air suspension system. To ensure the supply of compressed air to these subsystems, a compressed air supply device which includes a compressor is normally provided in the commercial vehicle. The compressor is driven mechanically by an engine of the commercial vehicle. The coupling of the compressor normally takes place by means of a toothing on one end of the crankshaft of the drive engine. The compressor itself has a further crankshaft, with a hydraulic pump, for example a power steering pump, often being arranged on the side of the further crankshaft which faces away from the drive-side toothing. The hydraulic pump is connected to the shaft of the compressor by way of a radial-play compensating bearing, for example a Maltese cross, or a multitooth bearing which can withstand a higher torque, but tolerates a smaller degree of play, than the Maltese cross.

Furthermore, in modern commercial vehicles, a clutch is often provided, which is capable of completely decoupling the compressor from the drive engine in order to save energy. In the conventional arrangement of the hydraulic pump on the drive output side of the crankshaft of the compressor, this means that the hydraulic pump is also decoupled from the drive at the same time as the compressor. However, this has the result that, for example, steering assistance in the form of a power steering system for the vehicle would no longer be available. This cannot be tolerated for safety reasons.

Various alternatives are known for solving this problem. One option is to reduce the action of the steering assistance when the compressor is shut down. In this variant, it is assumed that the compressor can be decoupled primarily on motorways. On such roads, on account of the small radii of the curves, the steering assistance is also not absolutely necessary. However, if a steering maneuver must be carried out, for example for collision avoidance, the steering assistance is not available and the compressor would have to be activated.

A further option is for the steering assistance to be provided purely electrically. A power steering pump which is driven mechanically by the drive engine is then no longer provided, and the pump requires a separate electric motor. This can be realized in principle, but the electric motor must be capable of generating a high power of approximately 50 kW, and it therefore also takes up a corresponding amount of space and weight. Furthermore, the energy consumption is less expedient.

It is therefore an object of the present invention to improve upon a compressor system such that a complete decoupling of the compressor from the drive engine with simultaneous operation of the hydraulic pump is possible without a large amount of excess mechanical expenditure.

This and other objects are achieved by a compressor system for supplying compressed air in a commercial vehicle, having a compressor, a clutch and a hydraulic pump, with it being possible for the compressor system to be driven via a drivetrain and for the compressor to be completely decoupled from a drive engine by way of the clutch. The drivetrain includes a gear drive via which the hydraulic pump can be driven. The clutch is arranged between the gear drive and the compressor.

Here, the arrangement of the clutch between the gear drive and the compressor is not to be understood to mean that the clutch is positioned spatially between the gear drive and the compressor. The expression "between" rather describes the path of the transmitted force. The force is transmitted from the gear drive via the clutch to the compressor. It is, however, contemplated for the clutch to also be arranged spatially between the gear drive and the compressor on account of structural requirements. As a result of the arrangement of the clutch between the gear drive and the compressor, decoupling of the compressor from the drive engine is possible without adversely affecting the drive of the hydraulic pump. Here, the only additional mechanical component required is the gear drive in the drivetrain, via which gear drive a power take-off is provided for the hydraulic pump. Furthermore, the mechanical connection of the compressor system to the drive engine may remain unchanged in relation to a conventional compressor system.

Here, it is preferably provided that the compressor and the hydraulic pump are integrated in a common housing. The accommodation of the compressor and hydraulic pump in a common housing facilitates the cooling of both components, because a common cooling system can be used. For example, the common housing can be cooled overall in a simple manner.

It is particularly preferable for the gear drive to have a transmission ratio not equal to one. By providing a transmission ratio not equal to one in the gear drive, the compressor and the hydraulic pump can be operated at different rotational speeds. This enables a separate optimization of the compressor and hydraulic pump for the vehicle.

It is also advantageous for the compressor system to include a further drive on that side of the compressor which faces away from the gear drive. By providing a further drive on that side of the compressor which faces away from the gear drive, a mechanically more stable construction is made possible. The further drive may, for example, be designed as a further gear drive, as a belt drive or as a chain drive. Furthermore, on that side of the compressor which faces away from the gear drive, a connection facility for the hydraulic pump is provided which is not restricted by the compressor in terms of the available installation space. In this design, a second connection facility may also be provided which may be used for connecting a further auxiliary unit, for example a coolant pump.

It may be provided that the gear drive is mounted partially by way of a bush, and that the bush simultaneously serves to mount a crankshaft of the compressor. The gearwheels used in the gear drive are conventionally rotatably mounted, wherein the simultaneous use of a bearing point of a gearwheel of the gear drive for mounting the crankshaft simplifies the mechanical design of the compressor system.

Here, it is provided in particular that the gear drive and the crankshaft are coupled to one another in a freely rotatable manner by way of the bush. The freely rotating coupling between the gear drive and the crankshaft makes the shutdown of the compressor by way of the clutch possible for the first time.

A method for operating a compressor system is improved in that the hydraulic pump is driven by the drivetrain via a gear drive, and in that the drivetrain is separated between the gear drive and the compressor in order to decouple the compressor from the drive engine. In this way, the advantages of the compressor system according to the invention are also realized within the context of a method. This also applies to the particularly preferred embodiments of the method according to the invention specified below.

The method is expediently refined in that the compressor and the hydraulic pump are integrated in a common housing. It is preferably provided here that the hydraulic pump is driven via the gear drive with a transmission ratio not equal to one. And, it is particularly preferable for the compressor to be driven via a further drive which is arranged behind the gear drive as viewed from the drivetrain.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
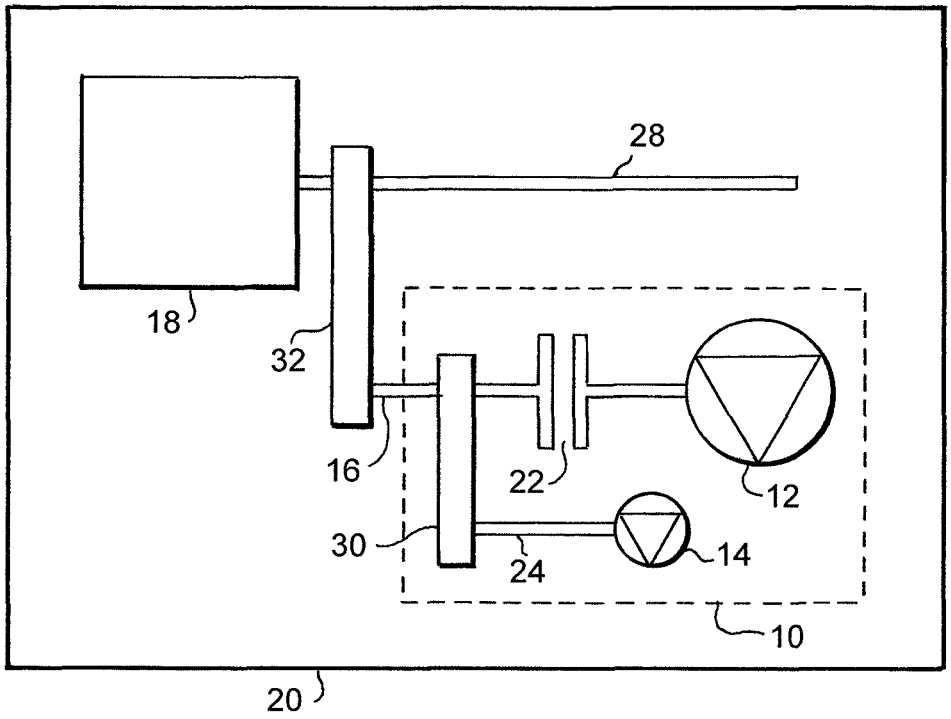
FIG. 1 is a schematic illustration of a commercial vehicle having an exemplary compressor system according to the invention.

In the following drawings, the same reference numerals denote identical or similar parts.

FIG. 1 is an exemplary schematic illustration of a commercial vehicle having a compressor system according to the invention. The commercial vehicle 20 illustrated includes a drive engine 18 and is driven by the drive engine 18 via a drivetrain 28. A drivetrain 16 for a compressor system 10, which includes a compressor 12 and a hydraulic pump 14, is branched off from the drivetrain 28 via a drive 32. The compressor system 10 is driven as a whole by the drivetrain 16, with a power take-off 24 for driving the hydraulic pump 14 being provided by way of a gear drive 30. A clutch 22 is arranged between the gear drive 30 and the compressor 12, which clutch 22 can be opened and closed without influencing the operation of the hydraulic pump 14. Here, the switching of the clutch 22 may be performed by a control unit (not illustrated) which may, for example, be part of a compressed-air treatment system of the commercial vehicle 20. The transmission ratio of the gear drive 30 may be freely selected so as to enable a separate optimization of the hydraulic pump 14 and compressor 12. The transmission ratio may therefore in particular be selected to be either equal or not equal to one.

Figure 2:
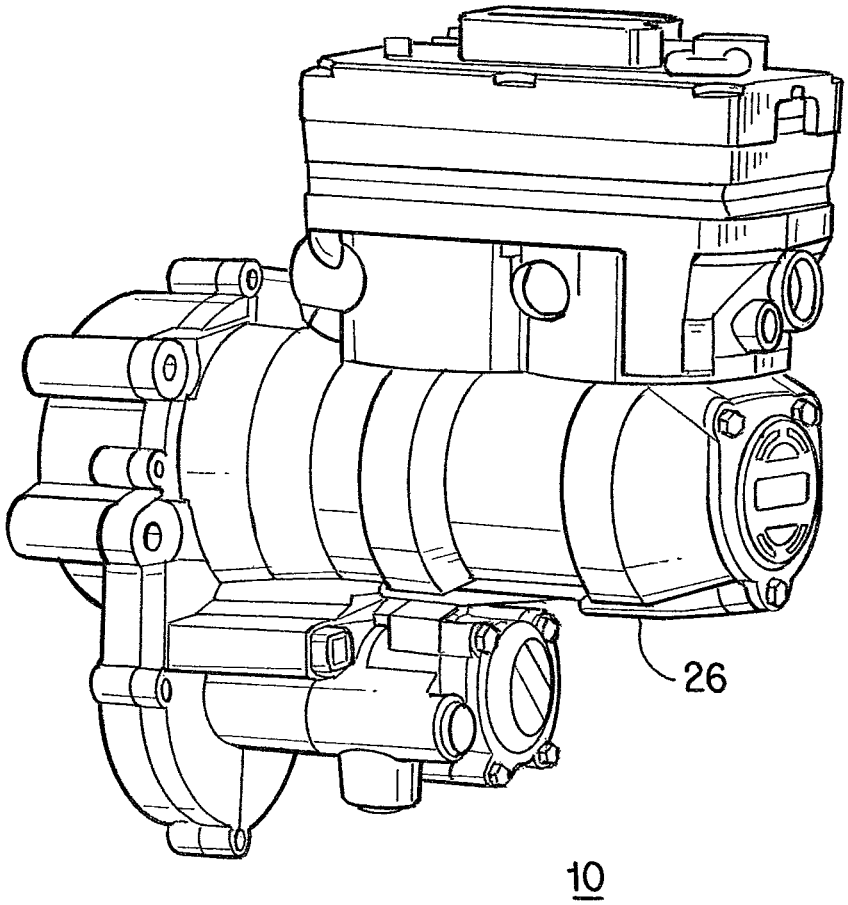
FIG. 2 is an external view of an exemplary compressor system according to the invention.

FIG. 2 shows an external view of a compressor system. The illustrated compressor system 10 is integrated in a common housing 26, with the compressor being arranged in the upper region and the hydraulic pump being arranged in the lower region.

Figure 3:
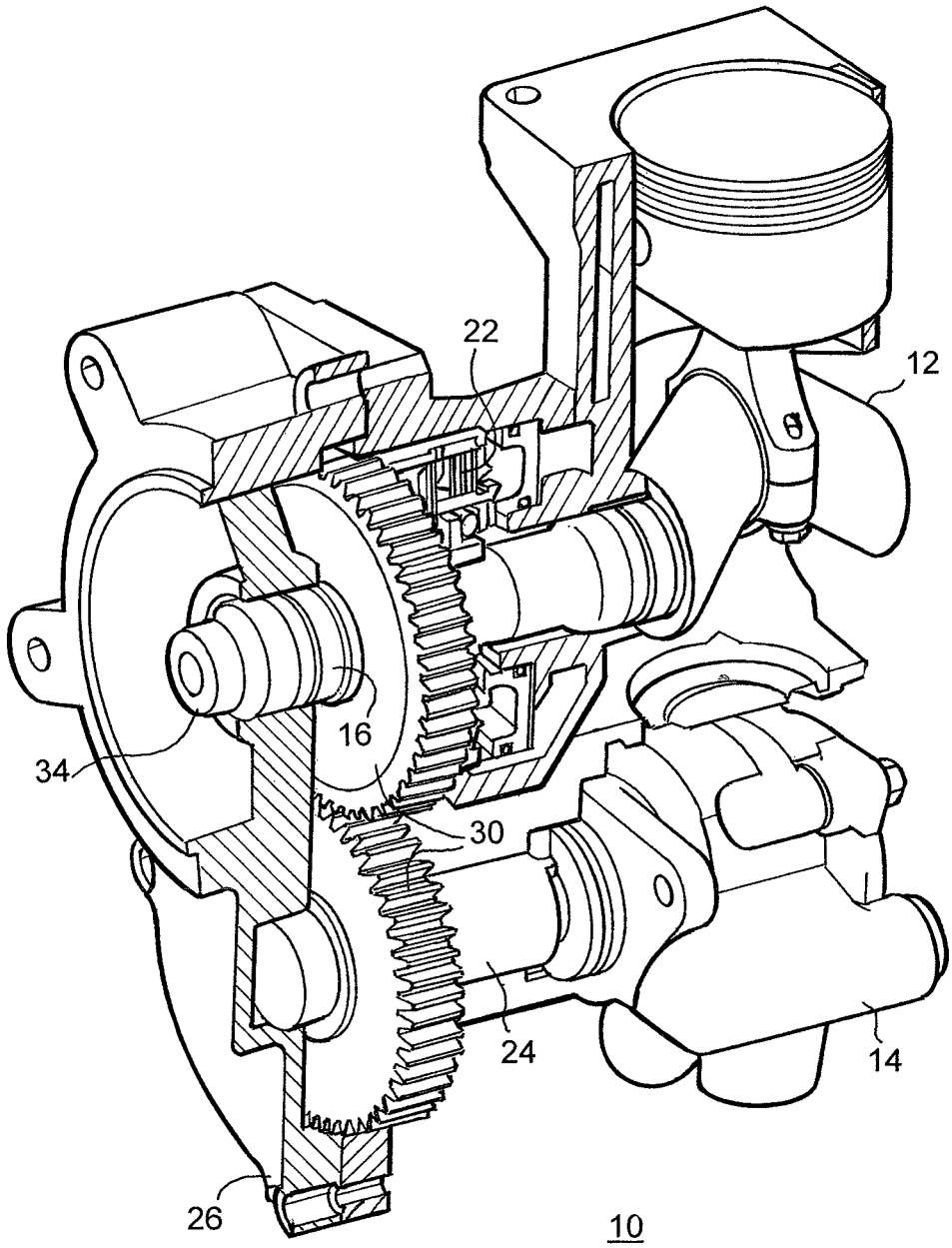
FIG. 3 is a cross section through an exemplary compressor system according to the invention.

FIG. 3 shows a cross section through a detail of the external view illustrated in FIG. 2. Again, the compressor 12 is arranged in the upper region and the power steering pump 14 is arranged in the lower region. The drivetrain 16 enters the common housing 26 of the compressor system 10 behind a standardizable coupling connection 34, with a power take-off 24 for driving a hydraulic pump 14 subsequently being provided by way of the gear drive 30. Furthermore, a clutch 22 is arranged between the gear drive 30 and the compressor 12. By using a single drivetrain 16 with a standardizable coupling connection 34 for driving the compressor system 10, it is possible for a standardized connection of the compressor system 10 to the drive engine 18 to be provided.

In particular, no further modifications are required in the region of the drivetrain 16 if a compressor system according to the invention is used instead of prior art compressor systems.

Figure 4:
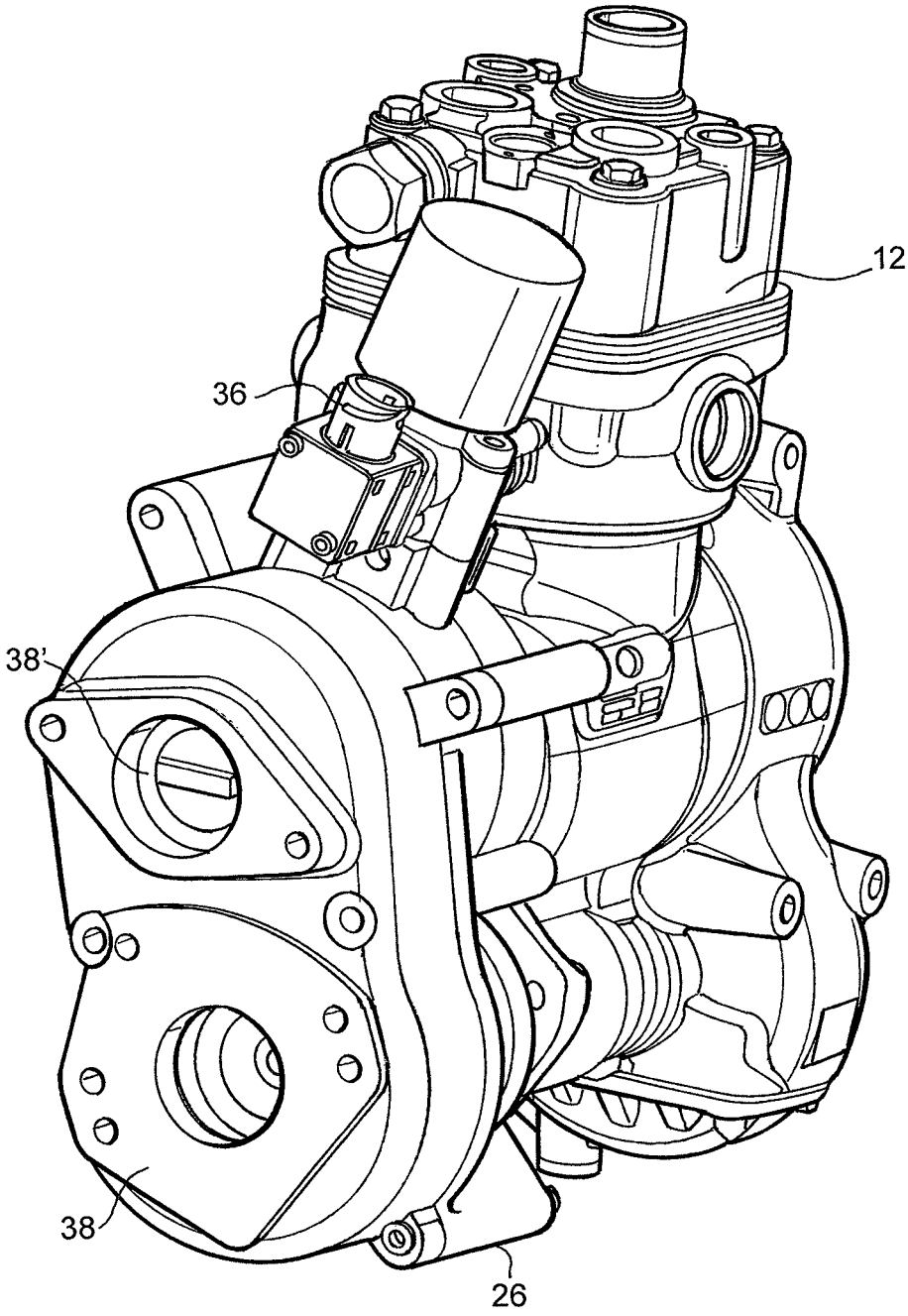
FIG. 4 is an external view of an exemplary compressor system according to the invention without a hydraulic pump mounted thereon.

FIG. 4 shows an external view of an exemplary compressor system according to the invention without a hydraulic pump mounted thereon. The illustration shows the compressor 12 which is arranged in the housing 26 and which can be separated from the drivetrain (not visible in this illustration) by way of a clutch control connection 36. Also visible in the foreground are a connecting flange 38 and a further connecting flange 38' to which the hydraulic pump can be connected. Depending on requirements, it is also contemplated for two hydraulic pumps to be operated simultaneously on the connecting flanges 38, 38', or for other auxiliary units to be supplied with drive energy.

Figure 5:
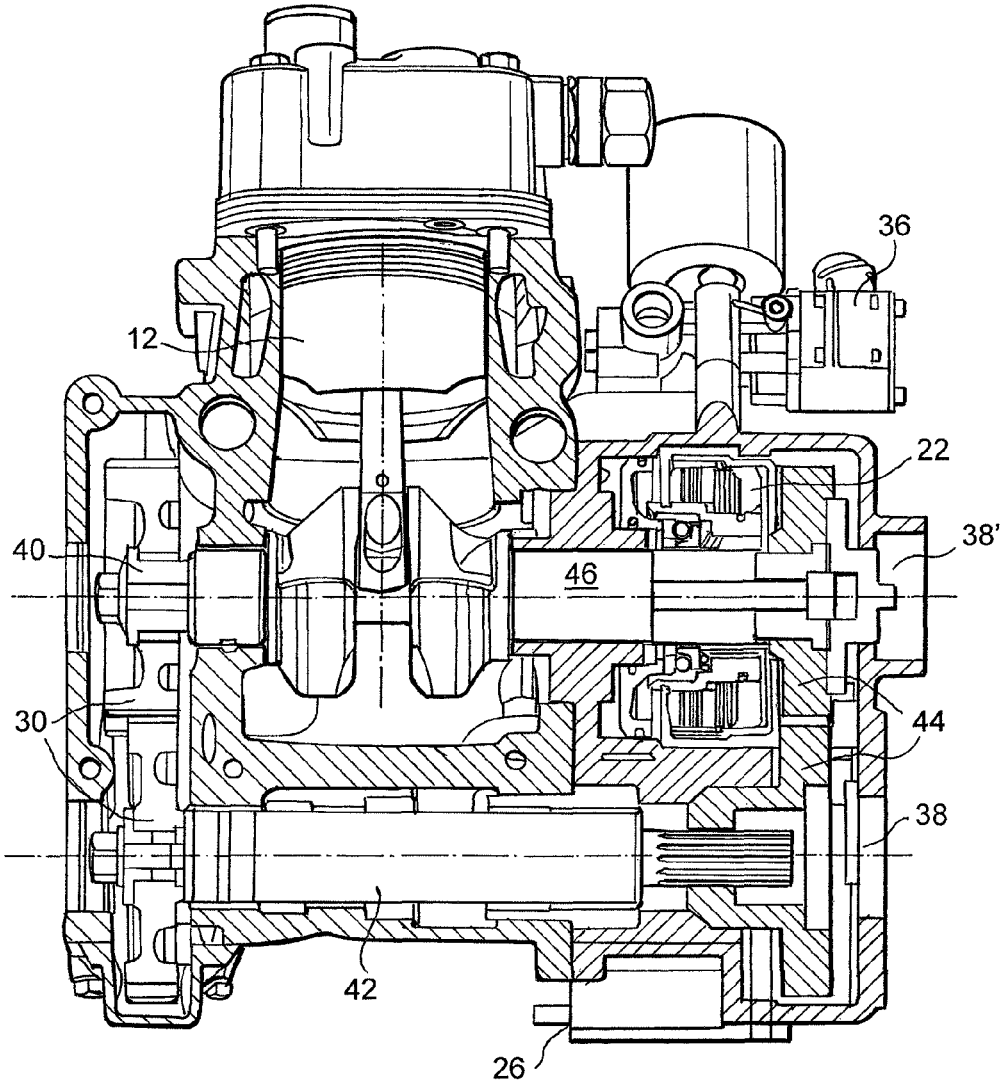
FIG. 5 is a cross section through an exemplary compressor system according to the invention without a hydraulic pump mounted thereon.

FIG. 5 is a cross section through a compressor system as shown in FIG. 4. The illustration shows in particular the gear drive 30 and a further gear drive 44, which gear drives 30, 44 are arranged on two different sides of the compressor 12. The clutch 22 is arranged between the further gear drive 44 and the compressor 12 and can be actuated via the clutch control connection 36. The transmission ratio of the further gear drive 44 may, similarly to the transmission ratio of the gear drive 30, be freely selected, and may in particular be either equal to or not equal to one. The force transmitted from the drivetrain (not illustrated) to the gear drive 30 is transmitted via a shaft 42 to the further gear drive 44. From there, the force can be picked off at the connecting flanges 38, 38', or is transmitted via the clutch 22 to the compressor 12. The connection between a crankshaft 46, which is assigned to the compressor 12, and the gear drive 30 takes place via a bush 40 which serves to mount both a gearwheel of the gear drive 30 and also the crankshaft 46. The use of two separate bushes, which may then be positioned in any desired manner, is likewise possible. Here, the mounting is freely rotatable, such that the gearwheel of the gear drive 30 can rotate independently of the crankshaft 46.

Figure 6:
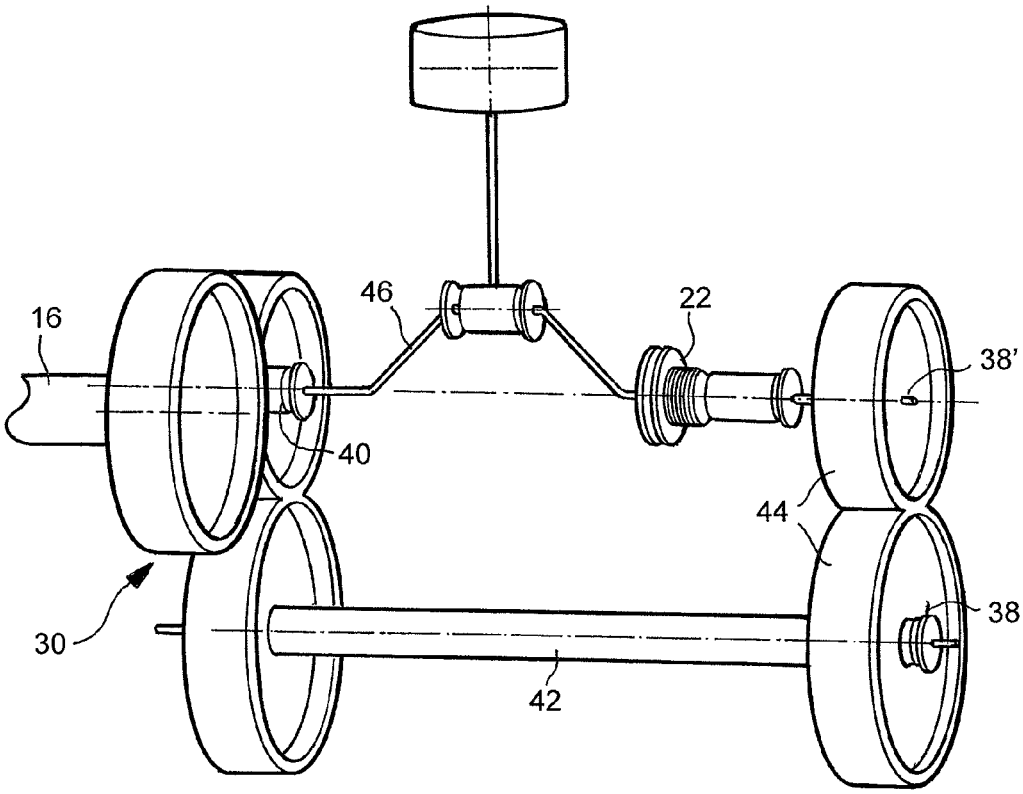
FIG. 6 schematically shows the design of a force-transmission path in a compressor system according to an exemplary embodiment of the invention.

FIG. 6 schematically shows a force-transmission path design in an exemplary compressor system according to the invention. Force in the form of a torque is transmitted to the gear drive 30 via the drivetrain 16. The illustrated gear drive 30 comprises three gearwheels, which for simplicity have been illustrated without their teeth. The force introduced into the gear drive 30 is transmitted via the shaft 42 to the further gear drive 44, which has two connecting flanges 38, 38' to which auxiliary units (not illustrated), for example the hydraulic pump, can be connected. The further gear drive 44 drives the crankshaft 46 of the compressor via the clutch 22, which crankshaft 46 is mounted, on the side facing toward the gear drive 30, by means of a bush 40. The bush 40 serves at the same time to mount a gearwheel of the gear drive 30, with the crankshaft 46 and the gearwheel of the gear drive 30 being rotatable independently of one another. The bush 40 thus serves to mount the crankshaft 46 in the compressor housing 26 and the gearwheel of the gear drive 30 on the crankshaft 46 in a freely rotatable manner. By actuating the clutch 22, it is therefore possible to interrupt the transmission of force to the crankshaft 46 of the compressor, while drive force in the form of torque can continue to be picked off at the connecting flanges 38, 38'.

Figure 7:
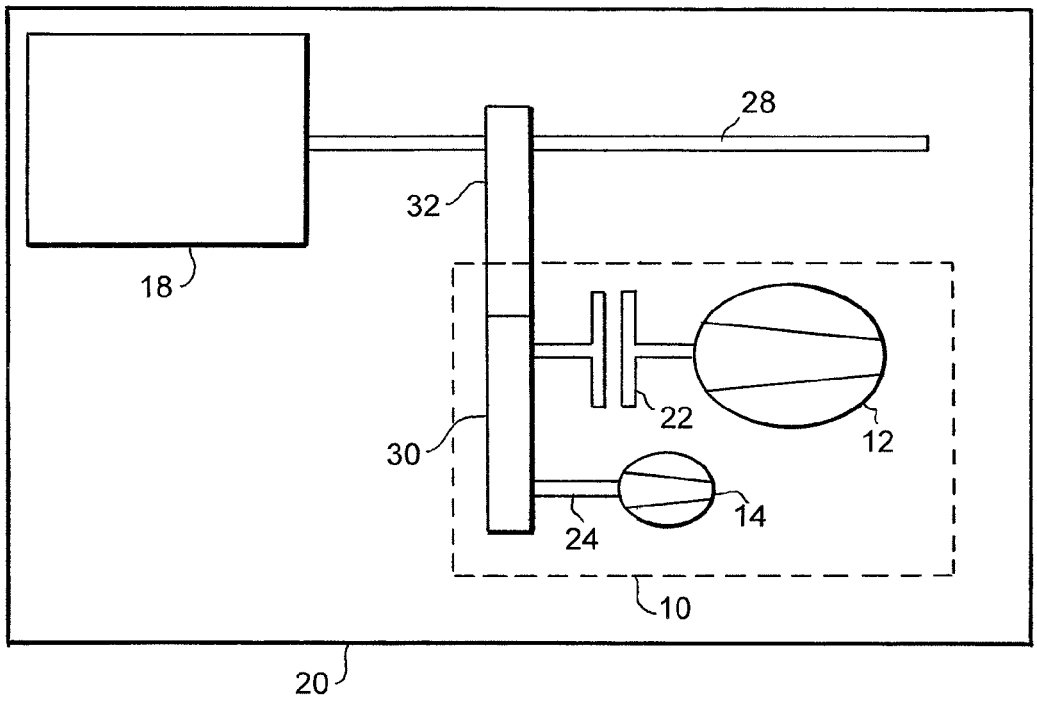
FIG. 7 is a schematic illustration of a commercial vehicle having a second embodiment of a compressor system according to the invention.

FIG. 7 is a schematic illustration of a commercial vehicle having a second embodiment of a compressor system according to the invention. In contrast to the embodiment illustrated in FIG. 1, the drive force for the compressor system 10 illustrated in FIG. 7 is transmitted directly from the drive 32 to the gear drive 30. A drivetrain, for example in the form of a shaft, may be omitted here. In the embodiment illustrated in FIG. 7, it is for example possible for a gearwheel of the drive 32 to engage directly into a gearwheel of the gear drive 30, and to thereby supply drive energy to the compressor system 10.

Figure 8:
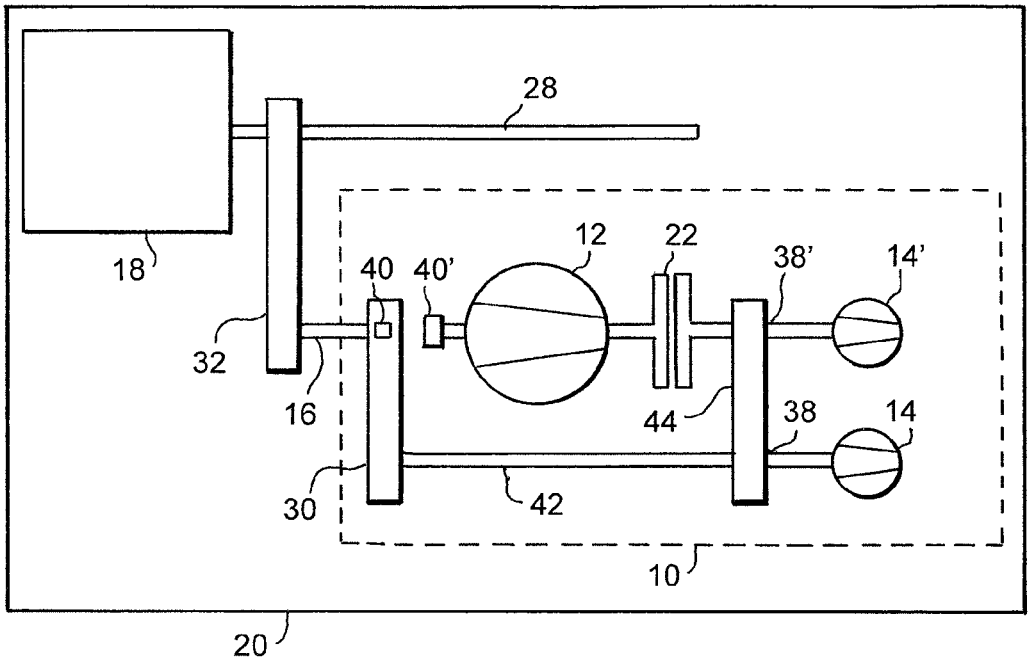
FIG. 8 is a schematic illustration of a commercial vehicle having a third embodiment of a compressor system according to the invention.

FIG. 8 shows a schematic illustration of a commercial vehicle having a third embodiment of a compressor system according to the invention. The embodiment of the compressor system 10 illustrated in FIG. 8 is based on the force-transmission path already described in FIG. 6. Drive energy is introduced into a gear drive 30 via a drive 32 and a drivetrain 16, with a gearwheel (not explicitly illustrated) of the gear drive 30 being mounted by a bush 40. The force introduced into the gear drive 30 is transmitted via a shaft 42 to a further gear drive 44 and is supplied from there via a clutch 22 to a compressor 12. Here, the crankshaft of the compressor 12 is mounted, on the side facing away from the clutch 22, by a bush 40'.

In this embodiment, in contrast to FIG. 6, the bush 40' is provided, which is arranged spatially separately from the bush 40. Furthermore, a connecting flange 38 and a further connecting flange 38' are provided on the further gear drive 44, to which connecting flanges a hydraulic pump 14 and a pump 14' can be connected. Here, the pump 14' symbolizes any desired auxiliary unit, for example a coolant pump, to be driven by the drive engine 18.

Figure 9:
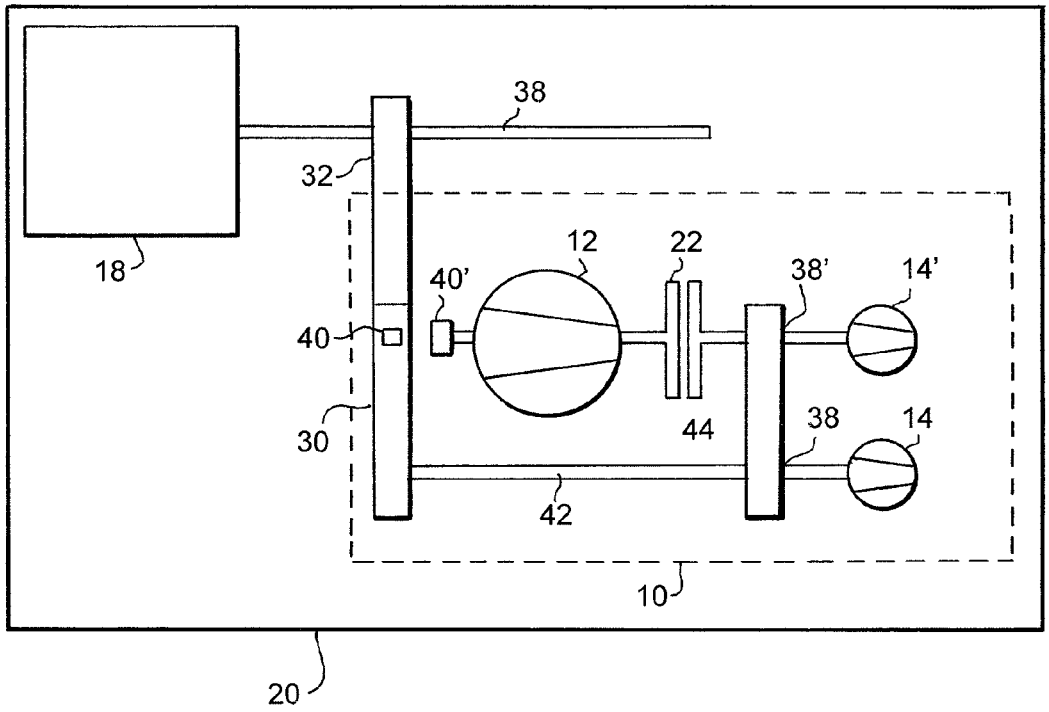
FIG. 9 is a schematic illustration of a commercial vehicle having a fourth embodiment of a compressor system according to the invention.

FIG. 9 is a schematic illustration of a commercial vehicle having a fourth embodiment of a compressor system according to the invention. The embodiment illustrated in FIG. 9 differs from the embodiment illustrated in FIG. 8 by the way in which torque is introduced into the compressor system 10. Similarly to the embodiment illustrated in FIG. 7, torque is transmitted directly from the drive 32 to the gear drive 30, with an interposed shaft being omitted.

Figure 10:
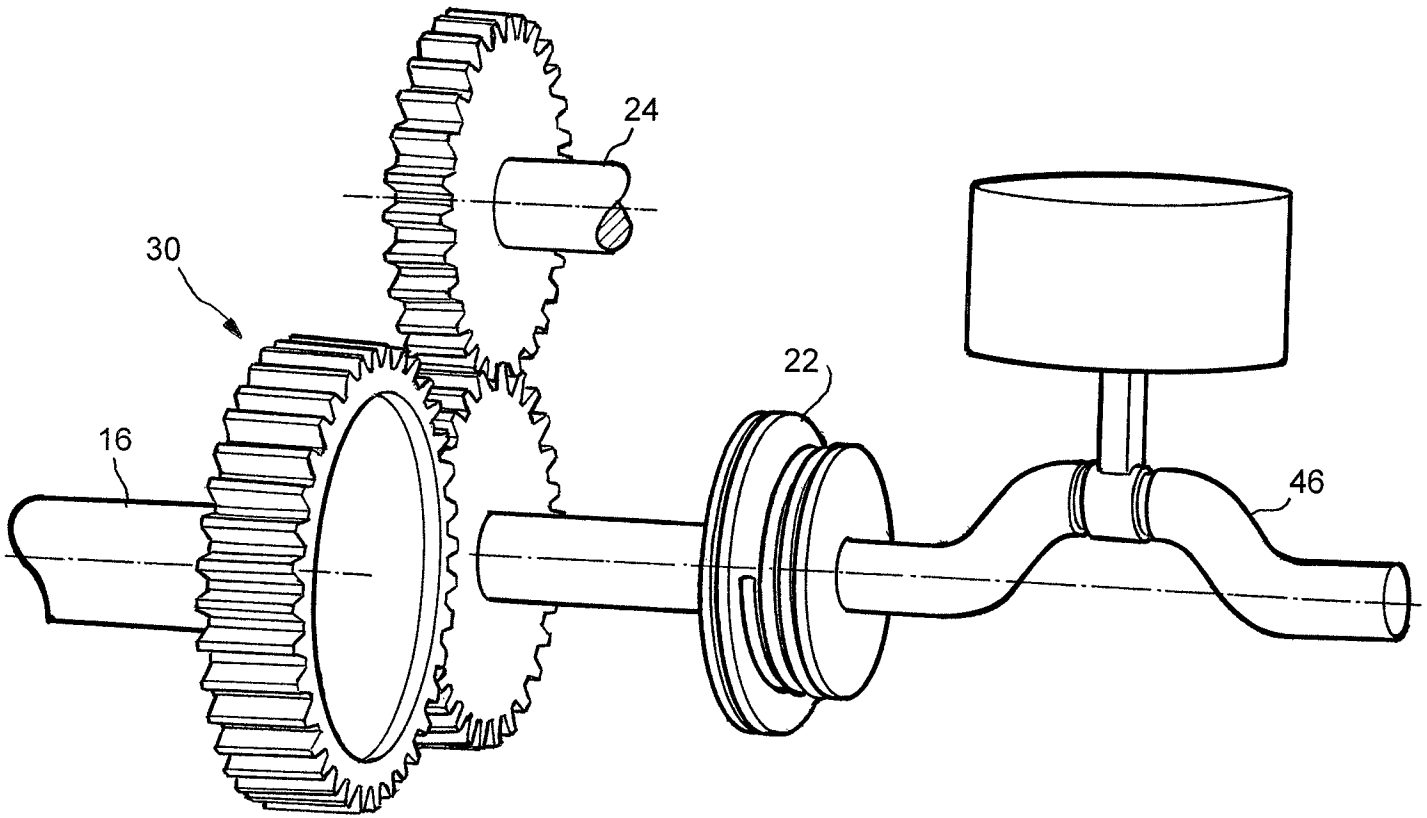
FIG. 10 shows a second embodiment of a force-transmission path in a compressor system according to the invention.

FIG. 10 shows a second embodiment of a force-transmission path in a compressor system according to the invention. The illustrated force-transmission path differs from the embodiment mentioned in FIG. 6 in particular in that the gear drive 30 comprises three gearwheels, and the drivetrain 16 and the crankshaft 46 are not commonly coupled to a single gearwheel of the gear drive 30. In this way, in designing the gear drive 30, the rotational speed of the compressor and of the auxiliary drive 24 can be varied in wide ranges.

Figure 11:
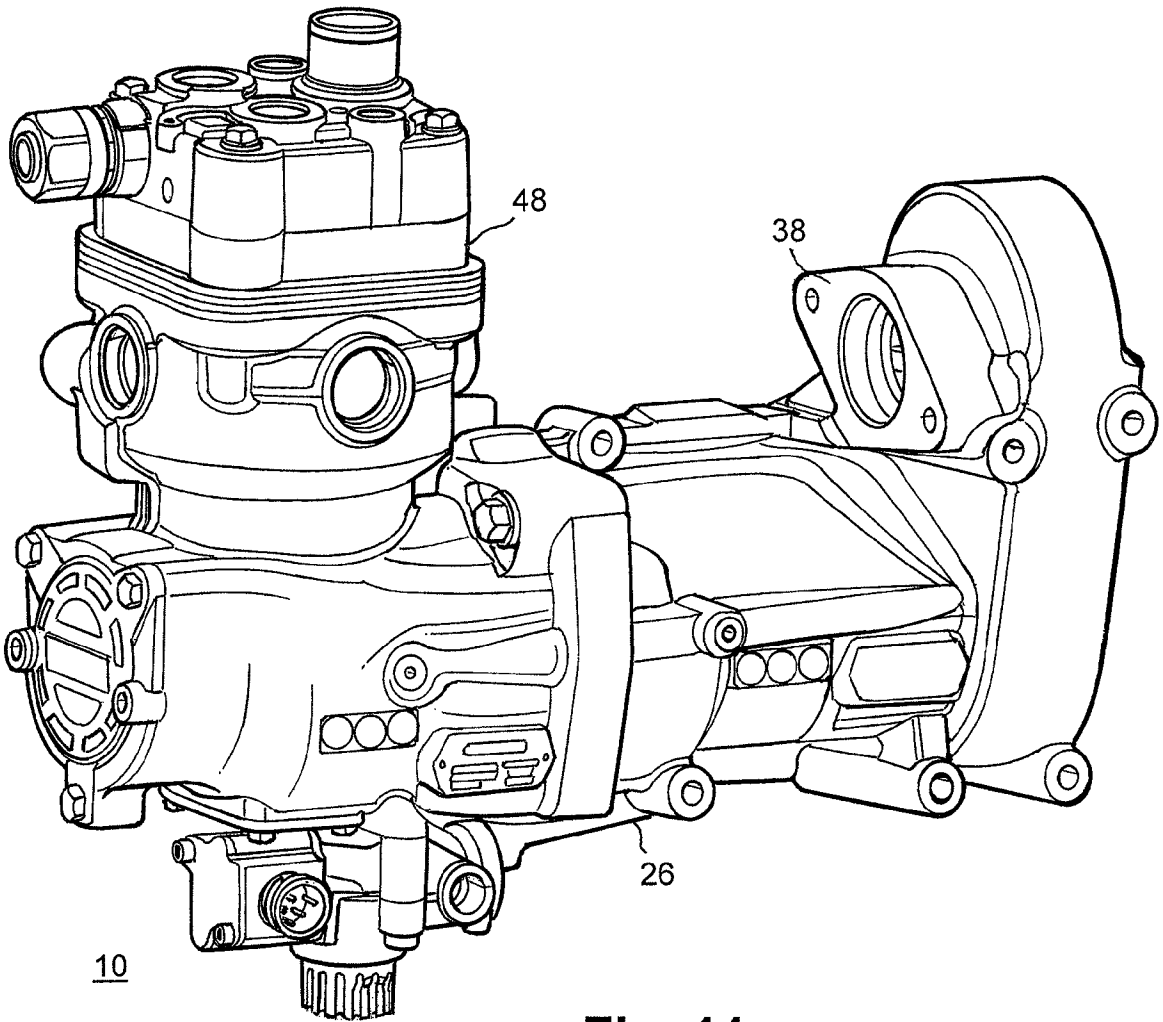
FIG. 11 shows a second external view of an exemplary compressor system according to the invention.

FIG. 11 shows a second external view of an exemplary compressor system according to the invention. The illustrated compressor system 10 differs from the compressor system 10 shown in FIG. 2 in particular by the mounting position of an auxiliary unit (not illustrated in FIG. 11), for example a hydraulic pump. The auxiliary unit is mounted on the connecting flange 38 such that it assumes a position between a cylinder head 48 of the compressor and the connecting flange 38 on the gear drive in the interior of the housing 26.

Figure 12:
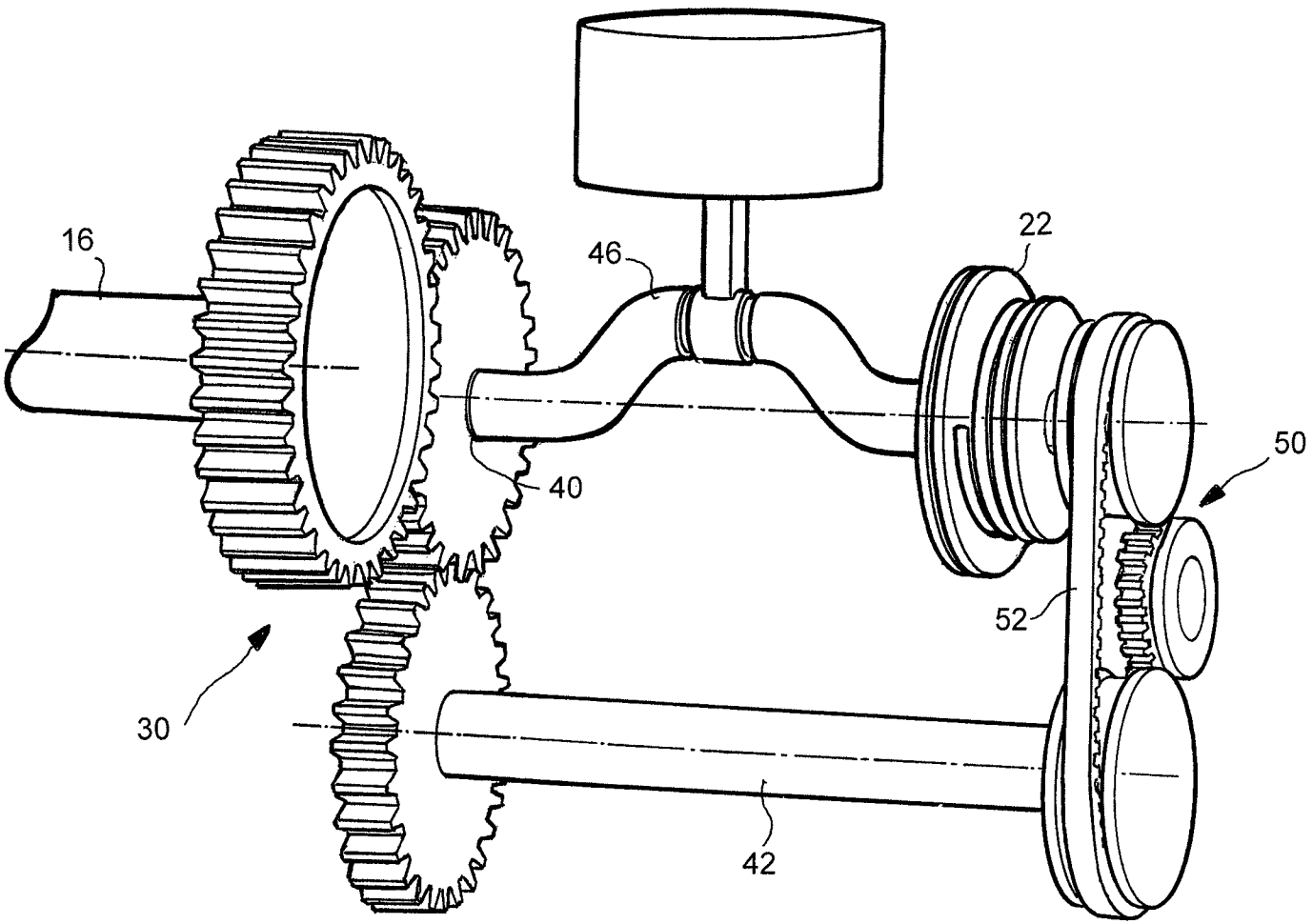
FIG. 12 shows a third embodiment of a force-transmission path in a compressor system according to the invention.

FIG. 12 shows a third embodiment of a force-transmission path in a compressor system according to the invention. The illustrated force-transmission path differs from the embodiment known from FIG. 6 by the use of a belt drive 50 having a belt 52 and an additional tensioning wheel, which belt drive performs the function of the further gear drive known from FIG. 6. For better clarity, connecting flanges for connecting auxiliary units have not been illustrated. Corresponding connection facilities may however be provided, similarly to FIG. 6.

Figure 13:
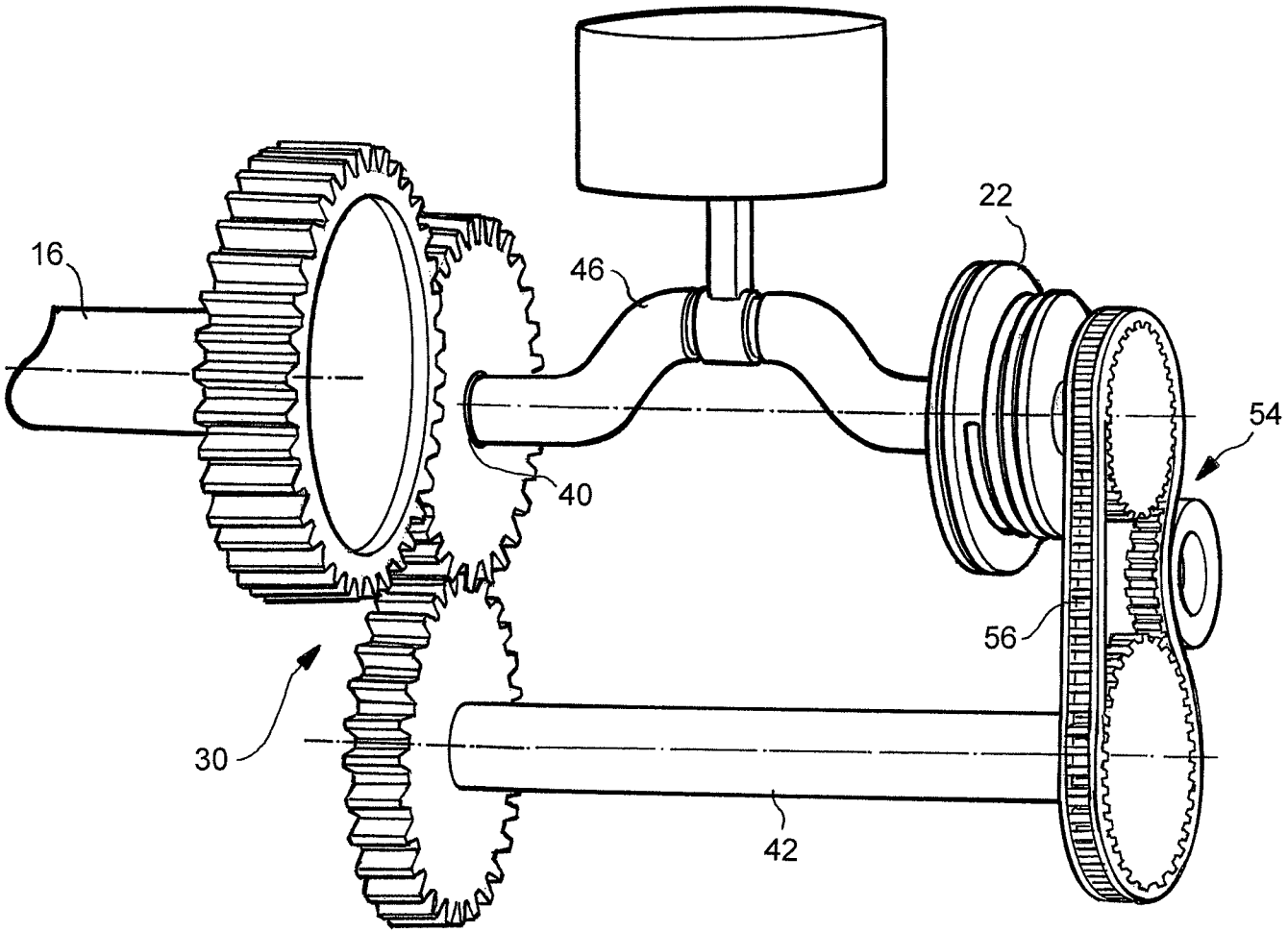
FIG. 13 shows a fourth embodiment of a force-transmission path in a compressor system according to the invention.

FIG. 13 shows a fourth embodiment of a force-transmission path in a compressor system according to the invention. Instead of the belt drive 50 known from FIG. 12, a chain drive 54 with a chain 56 and an additional tensioning wheel are used in FIG. 13. Connection facilities for auxiliary units may also be provided here, similarly to FIG. 12.

TABLE OF REFERENCE NUMERALS

10 Compressor system
12 Compressor
14 Hydraulic pump
14' Pump
16 Drivetrain
18 Drive engine
20 Commercial vehicle
22 Clutch
24 Power take-off
26 Housing
28 Drivetrain
30 Gear drive
32 Drive
34 Coupling connection

36 Clutch control connection
38 Connecting flange
38' Further connecting flange
40 Bush
40' Further bush
42 Shaft
44 Further gear drive
46 Crankshaft
48 Cylinder head
50 Belt drive
52 Belt
54 Chain drive
56 Chain The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A compressor system for supplying compressed air in a commercial vehicle, the compressor system comprising:
a compressor;
a clutch;
a hydraulic pump;
wherein
the compressor system is drivable via a drivetrain of the commercial vehicle, the compressor being completely decoupleable from a drive engine of the commercial vehicle via the clutch,
a gear drive through which the hydraulic pump is drivable, the clutch being arranged between the gear drive and the compressor, and
the gear drive provides different rotational speeds to drive the compressor and the hydraulic pump at two outputs that are separate from each other.

2. The compressor system according to claim 1, further comprising a common housing in which are integrated the compressor and the hydraulic pump.

3. The compressor system according to claim 1, further comprising a second drive, the second drive being operatively arranged on a side of the compressor facing away from the gear drive.

4. The compressor system according to claim 1, further comprising a bush, wherein the gear drive is mounted at least partially by way of the bush and the bush additionally mounts a crankshaft of the compressor.

5. The compressor system according to claim 4, wherein the gear drive and the crankshaft are coupled to one another in a freely rotatable manner via the bush.

6. A method of operating a compressor system in a commercial vehicle, the compressor system having a compressor, a clutch and a hydraulic pump, the method comprising the acts of:
driving the compressor system via a drivetrain of the commercial vehicle;
driving the hydraulic pump by the drivetrain via a gear drive;
separating the drivetrain between the gear drive and the compressor to completely decouple the compressor from a drive engine of the commercial vehicle; and
providing different rotational speeds to drive the compressor and the hydraulic pump at two outputs of the gear drive that are separate from each other.

7. The method according to claim 6, wherein the compressor and the hydraulic pump are integrated in a common housing.

8. The method according to claim 7, wherein the act of driving the hydraulic pump further comprises the act of driving the hydraulic pump via the gear drive having a transmission ratio not equal to one.

9. The method according to claim 6, further comprising the act of driving the compressor via a second drive operatively arranged behind the gear drive as viewed from the drivetrain.

10. The method according to claim 6, further comprising the act of driving the compressor via a second drive operatively arranged behind the gear drive as viewed from the drivetrain.

* * * * *